US012339046B2

(12) United States Patent
Matsusaka et al.

(10) Patent No.: US 12,339,046 B2
(45) Date of Patent: Jun. 24, 2025

(54) HEAT PUMP DEVICE

(71) Applicant: DAIKIN INDUSTRIES, LTD., Osaka (JP)

(72) Inventors: Yukio Matsusaka, Osaka (JP); Teruo Nishida, Osaka (JP); Kento Okuzawa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 486 days.

(21) Appl. No.: 17/279,778

(22) PCT Filed: Jul. 29, 2019

(86) PCT No.: PCT/JP2019/029665
§ 371 (c)(1),
(2) Date: Mar. 25, 2021

(87) PCT Pub. No.: WO2020/066273
PCT Pub. Date: Apr. 2, 2020

(65) Prior Publication Data

US 2021/0341192 A1 Nov. 4, 2021

(30) Foreign Application Priority Data

Sep. 28, 2018 (JP) ..... 2018-185412

(51) Int. Cl.
*F25B 5/02* (2006.01)
*F25B 41/20* (2021.01)
(Continued)

(52) U.S. Cl.
CPC ..... *F25B 47/02* (2013.01); *F25B 5/02* (2013.01); *F25B 41/20* (2021.01); *F25B 2400/19* (2013.01); *F25B 2600/25* (2013.01)

(58) Field of Classification Search
CPC .. F25B 5/02; F25B 47/02; F25B 41/24; F25B 41/26; F25B 41/22; F25B 41/20;
(Continued)

(56) References Cited

U.S. PATENT DOCUMENTS 5,937,660 A * 8/1999 Lau ..... F25B 41/20 62/509
9,410,727 B1 * 8/2016 Boyko ..... F25B 41/20
(Continued)

FOREIGN PATENT DOCUMENTS

JP 62-237260 A 10/1987
JP S62237260 A * 10/1987
(Continued)

OTHER PUBLICATIONS

International Preliminary Report on Patentability and Written Opinion of the International Searching Authority for corresponding International Application No. PCT/JP2019/029665, dated Apr. 8, 2021, with English translation.
(Continued)

*Primary Examiner* — Frantz F Jules
*Assistant Examiner* — Jason N Thompson
(74) *Attorney, Agent, or Firm* — Birch, Stewart, Kolasch & Birch, LLP

(57) ABSTRACT

A heat pump device comprises a refrigerant circuit in which a compressor, a first indoor heat exchanger, an electric expansion valve, and a heat source-side heat exchanger are connected in a loop, a second indoor heat exchanger arranged between the compressor and the electric expansion valve and configured to store refrigerant during positive cycle defrost operation, an electromagnetic valve arranged between the second indoor heat exchanger and the electric expansion valve and configured to adjust an amount of refrigerant stored in the second indoor heat exchanger
(Continued)

during the positive cycle defrost operation, and a control device that controls the compressor and the electric expansion valve.

13 Claims, 7 Drawing Sheets

(51) Int. Cl.
*F25B 41/26* (2021.01)
*F25B 47/02* (2006.01)

(58) Field of Classification Search
CPC ..... F25B 2600/25; F25B 2600/2507; F25B 2400/19; F25B 2400/0409
See application file for complete search history.

(56) References Cited

U.S. PATENT DOCUMENTS

| | | | | |
|---|---|---|---|---|
| 2006/0080989 | A1* | 4/2006 | Aoki | F25B 40/00 62/324.4 |
| 2006/0107671 | A1 | 5/2006 | Yoshida et al. | |
| 2008/0302112 | A1* | 12/2008 | Anderson | F25B 45/00 62/93 |
| 2009/0151378 | A1* | 6/2009 | Kawakatsu | F25B 49/02 62/428 |
| 2011/0041523 | A1 | 2/2011 | Taras et al. | |
| 2016/0238297 | A1* | 8/2016 | Nuno | F25B 41/20 |
| 2017/0146269 | A1 | 5/2017 | Ishiyama et al. | |

FOREIGN PATENT DOCUMENTS

| | | | | |
|---|---|---|---|---|
| JP | 1-179874 | A | 7/1989 | |
| JP | H01179874 | A * | 7/1989 | |
| JP | 9-138019 | A | 5/1997 | |
| JP | 2002-156166 | A | 5/2002 | |
| JP | 2009-41845 | A | 2/2009 | |
| JP | 2009-174800 | A | 8/2009 | |
| JP | 2015-68609 | A | 4/2015 | |
| JP | 2015-117854 | A | 6/2015 | |
| JP | 6138711 | B2 | 5/2017 | |
| WO | WO-2016139783 | A1 * | 9/2016 | F25B 1/00 |

OTHER PUBLICATIONS

Extended European Search Report for European Application No. 19864931.1, dated Feb. 11, 2022.
Partial Supplementary European Search Report for European Application No. 19864931.1, dated Oct. 1, 2021.

* cited by examiner

HEAT PUMP DEVICE

TECHNICAL FIELD

The present disclosure relates to a heat pump device.

BACKGROUND ART

Conventionally, some heat pump devices include a refrigerant circuit in which a compressor, an indoor heat exchanger, an expansion valve and an outdoor heat exchanger are connected in a loop (see, for example, JP 6138711 B2 (Patent Literature 1)).

The heat pump device is provided with a defrosting bypass circuit that branches off from a pipe that connects the discharge side of the compressor and a four-way valve and bypasses to piping that connects the outdoor heat exchanger and the outdoor expansion valve, and a defrosting expansion valve is provided in this defrosting bypass circuit.

In the above heat pump device, during the heating operation, the defrosting expansion valve operates so as to close the defrosting bypass circuit, and during the defrosting operation, the defrosting expansion valve is opened to a predetermined opening degree and a high temperature and high pressure refrigerant discharged from the compressor is made to flow through the defrosting bypass circuit to defrost the outdoor heat exchanger.

CITATIONS LIST

Patent Literature

Patent Literature 1: JP 6138711 B2

SUMMARY OF INVENTION

Technical Problems

However, in the heat pump device, because the amount of refrigerant required during the defrosting operation is smaller than the amount of refrigerant required during the heating operation, excess refrigerant is generated during the defrosting operation. Therefore, in the above heat pump device, there is a problem that the reliability of the compressor is lowered due to the surplus refrigerant, or the defrosting performance is lowered due to the wet operation.

The present disclosure proposes a heat pump device that can improve the reliability and defrosting performance of a compressor.

Solutions to Problems

A heat pump device of the present disclosure includes: a refrigerant circuit in which a compressor, a use-side heat exchanger, an expansion mechanism, and a heat source-side heat exchanger are connected in a loop; a storage unit arranged between the compressor and the expansion mechanism and configured to store the refrigerant during positive cycle defrost operation; a flow rate adjusting unit arranged between the storage unit and the expansion mechanism and configured to adjust an amount of refrigerant stored in the storage unit during the positive cycle defrost operation; and a control device that controls the compressor and the flow rate adjusting unit.

According to the present disclosure, the flow rate adjusting unit is controlled by the control device to adjust the amount of refrigerant stored in the storage unit during the positive cycle defrost operation. As a result, the amount of refrigerant required for the positive cycle defrost operation can be circulated in the refrigerant circuit, and the reliability and defrosting performance of the compressor can be improved.

Further, in the heat pump device according to one aspect of the present disclosure, the storage unit is a second use-side heat exchanger connected in parallel to the use-side heat exchanger, and the control device controls the flow rate adjusting unit so as to throttle the flow rate of the refrigerant flowing out from an expansion-mechanism-side port of the second use-side heat exchanger during the positive cycle defrost operation to store the refrigerant in the second use-side heat exchanger.

According to the above present disclosure, during the positive cycle defrost operation, the flow rate adjusting unit arranged between the second use-side heat exchanger and the expansion mechanism is closed or the opening degree thereof is throttled to store excess refrigerant in the second use-side heat exchanger. Therefore, because the use-side heat exchanger is divided into at least two parts and one of the divided parts is used as the storage unit without providing a separate storage unit, the configuration can be simplified and the cost can be reduced.

Further, in the heat pump device according to one aspect of the present disclosure, the storage unit is a refrigerant container connected in parallel to a pipe between the use-side heat exchanger and the expansion mechanism, and the flow rate adjusting unit is a first flow rate adjusting unit that throttles the flow rate of the refrigerant flowing out from an expansion-mechanism-side port of the refrigerant container.

According to the present disclosure, during the positive cycle defrost operation, by closing the first flow rate adjusting unit or throttling the opening degree thereof, the excess refrigerant can be stored in the refrigerant container connected in parallel to the pipe between the use-side heat exchanger and the expansion mechanism.

Further, the heat pump device according to one aspect of the present disclosure further includes a second flow rate adjusting unit that opens and closes an use-side-heat-exchanger-side port of the refrigerant container, and in the heat pump device, during the positive cycle defrost operation, the control device opens the second flow rate adjusting unit in a state in which the flow rate of the refrigerant flowing out from the expansion-mechanism-side port of the refrigerant container is throttled or set to zero by the first flow rate adjusting unit.

According to the present disclosure, during the positive cycle defrost operation, by opening the second flow rate adjusting unit in a state in which the flow rate of the refrigerant flowing out from the expansion-mechanism-side port of the refrigerant container is throttled or set to zero by the first flow rate adjusting unit, the use-side-heat-exchanger-side port of the refrigerant container is opened. As a result, the excess refrigerant can be stored in the refrigerant container. In the cooling operation and the heating operation, by closing the second flow rate adjusting unit, the refrigerant can be prevented from being stored in the refrigerant container.

Further, the heat pump device according to one aspect of the present disclosure further includes a third flow rate adjusting unit connected in parallel to the refrigerant container, in the pipe between the use-side heat exchanger and the expansion mechanism, and in the heat pump device, the control device closes the third flow rate adjusting unit in a state of the first and second flow rate adjusting units being opened, during a period from a predetermined time before the positive cycle defrost operation is started to the time when the positive cycle defrost operation is started, and during the positive cycle defrost operation, opens the second and third flow rate adjusting units in a state in which the flow rate of the refrigerant flowing out from the expansion-mechanism-side port of the refrigerant container is throttled by the first flow rate adjusting unit.

According to the present disclosure, during a period from a predetermined time before the positive cycle defrost operation is started to the time when the positive cycle defrost operation is started, the refrigerant is made to flow only through the refrigerant container by closing the third flow rate adjusting unit in a state of the first and second flow rate adjusting units being opened, and when the positive cycle defrost operation is started, the second and third flow rate adjusting units are opened in a state in which the flow rate of the refrigerant flowing out from the expansion-mechanism-side port of the refrigerant container is throttled by the first flow rate adjusting unit. As a result, the excess refrigerant can be reliably stored in the refrigerant container.

Further, the heat pump device according to one aspect of the present disclosure further includes: a bypass circuit that connects the discharge port side and the intake port side of the compressor; and a bypass circuit flow rate adjusting unit arranged in the bypass circuit and controlled by the control device.

According to the present disclosure, by the control device controlling the bypass circuit flow rate adjusting unit arranged in the bypass circuit connecting the discharge port side and the intake port side of the compressor, the bypass circuit flow rate adjusting unit is opened during the positive cycle defrost operation. As a result, the liquid back to the compressor and the decrease in high pressure can be suppressed.

Further, in the heat pump device according to one aspect of the present disclosure, the control device controls the flow rate adjusting unit so that, during the positive cycle defrost operation, as the temperature difference between the intake refrigerant temperature of the compressor and the temperature of the heat source-side heat exchanger increases, the opening degree of the flow rate adjusting unit increases, and meanwhile, as the above temperature difference reduces, the opening degree of the flow rate adjusting unit reduces.

According to the present disclosure, the amount of heat required for defrosting the heat source-side heat exchanger can be secured, and the defrosting performance can be further improved.

Further, in the heat pump device according to one aspect of the present disclosure, the control device controls the flow rate adjusting unit so that, during the positive cycle defrost operation, as the discharge refrigerant temperature of the compressor becomes higher, the opening degree of the flow rate adjusting unit increases, and meanwhile, as the discharge refrigerant temperature of the compressor becomes lower, the opening degree of the flow rate adjusting unit reduces.

According to the present disclosure, the amount of heat required for defrosting the heat source-side heat exchanger can be secured, and the defrosting performance can be further improved.

DESCRIPTION OF EMBODIMENTS

Figure 1:
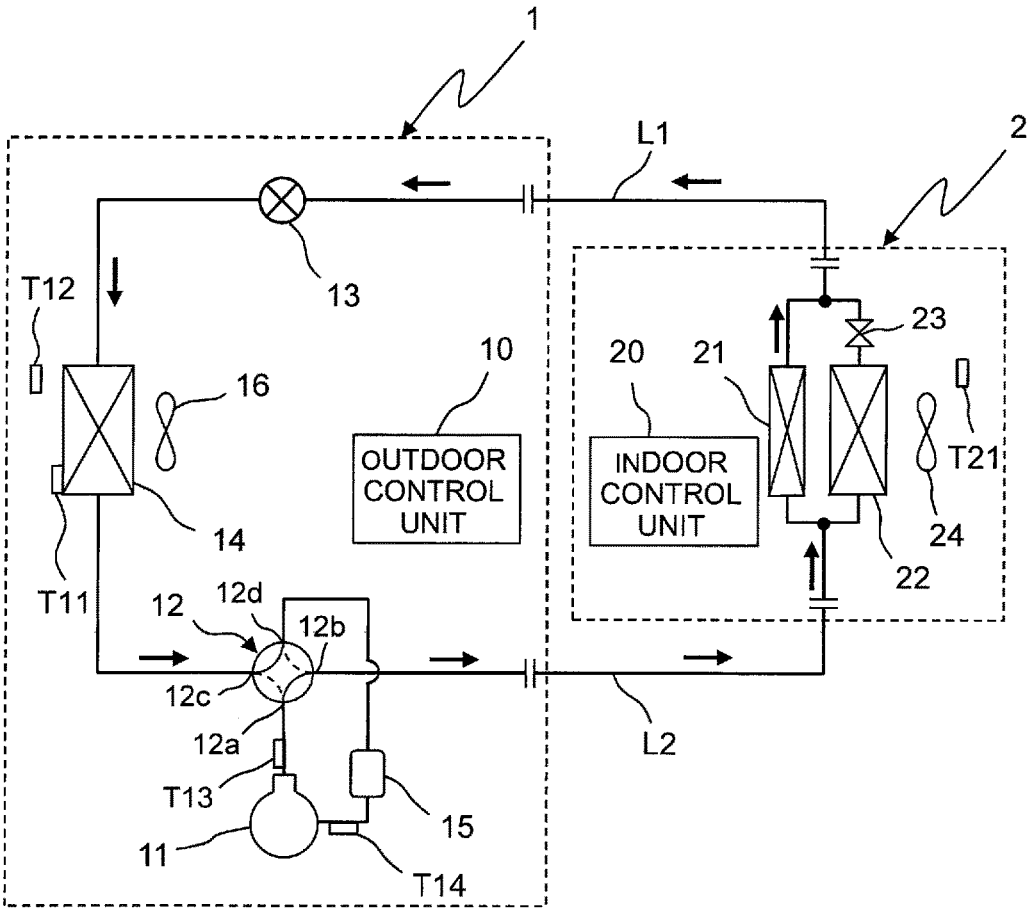
FIG. 1 is a circuit diagram of a refrigerant circuit of an air conditioner as an example of a heat pump device according to a first embodiment of the present disclosure.

Hereinafter, embodiments are described. Note that, in the drawings, identical reference signs represent identical or corresponding parts.

First Embodiment

FIG. 1 shows a refrigerant circuit of an air conditioner as an example of a heat pump device according to a first embodiment of the present disclosure.

As shown in FIG. 1, the air conditioner of the first embodiment includes an outdoor unit 1 and an indoor unit 2 connected to the outdoor unit 1 via connection pipes L1 and L2. This air conditioner is a pair type in which the outdoor unit 1 is paired one-to-one with the indoor unit 2.

The outdoor unit 1 includes an outdoor control unit 10, a compressor 11, a four-way switching valve 12, an electric expansion valve 13, an outdoor heat exchanger 14, an accumulator 15, and an outdoor fan 16. The electric expansion valve 13 is an example of an expansion mechanism, and the outdoor heat exchanger 14 is an example of a heat source-side heat exchanger. Further, the outdoor fan 16 supplies the outdoor air to the outdoor heat exchanger 14.

Further, the outdoor unit 1 includes an outdoor heat exchanger temperature sensor T11 that detects the temperature of the outdoor heat exchanger 14, an outdoor air temperature sensor T12 that detects the outdoor air temperature, a discharge refrigerant temperature sensor T13 that detects the discharge refrigerant temperature of the compressor 11, and an intake refrigerant temperature sensor T14 that detects the intake refrigerant temperature of the compressor 11.

Further, the indoor unit 2 includes an indoor control unit 20, a first indoor heat exchanger 21, a second indoor heat exchanger 22, an electromagnetic valve 23, an indoor fan 24, and an indoor temperature sensor T21 that detects the indoor temperature. The first indoor heat exchanger 21 is connected in parallel to the second indoor heat exchanger 22. Further, the electromagnetic valve 23 is arranged at an electric-expansion-valve 13-side (connection-pipe L1-side) port of the second indoor heat exchanger 22. The indoor fan 24 circulates indoor air through the first and second indoor heat exchangers 21 and 22. The electromagnetic valve 23 is an example of a flow rate adjusting unit. Further, the first indoor heat exchanger 21 is an example of a first use-side heat exchanger, and the second indoor heat exchanger 22 is an example of a second use-side heat exchanger. Further, the second indoor heat exchanger 22 is an example of a storage unit. The second indoor heat exchanger 22 is located on the downstream side in the refrigerant flow of the compressor 11 in the positive cycle defrost operation and on the upstream side in the refrigerant flow of the electric expansion valve 13 in the positive cycle defrost operation.

The discharge side of the compressor 11 is connected to a first port 12*a* of the four-way switching valve 12. A second port 12*b* of the four-way switching valve 12 is connected to one end of each of the first indoor heat exchanger 21 and the second indoor heat exchanger 22 via the connection pipe L2. The other end of the first indoor heat exchanger 21 is connected to one end of the electric expansion valve 13 via the connection pipe L1, and the other end of the second indoor heat exchanger 22 is connected to the one end of the electric expansion valve 13 via the electromagnetic valve 23 and the connection pipe L1. The other end of the electric expansion valve 13 is connected to one end of the outdoor heat exchanger 14, and the other end of the outdoor heat exchanger 14 is connected to a third port 12*c* of the four-way switching valve 12. Then, a fourth port 12*d* of the four-way switching valve 12 is connected to the intake side of the compressor 11 via the accumulator 15.

The compressor 11, the four-way switching valve 12, the first and second indoor heat exchangers 21 and 22, the electric expansion valve 13, the outdoor heat exchanger 14, and the accumulator 15 are connected in a loop to constitute the refrigerant circuit.

The outdoor control unit 10 includes a microcomputer, an input/output circuit, and others, and controls the compressor 11, the four-way switching valve 12, the electric expansion valve 13, the outdoor fan 16, and others based on the detection signals of the outdoor heat exchanger temperature sensor T11, the outdoor air temperature sensor T12, the discharge refrigerant temperature sensor T13, and the intake refrigerant temperature sensor T14. Further, the indoor control unit 20 includes a microcomputer, an input/output circuit, and others, and controls the electromagnetic valve 23, the indoor fan 24, and others based on the detection signals of the indoor temperature sensor T21. The outdoor control unit 10 and the indoor control unit 20 operate as air conditioners by communicating with each other via a communication line (not shown) and operating in cooperation with each other. The outdoor control unit 10 and the indoor control unit 20 constitute a control device.

Next, the cooling operation, the heating operation, and the positive cycle defrost operation performed by the outdoor control unit 10 and the indoor control unit 20 are described. The electromagnetic valve 23 of the indoor unit 2 is opened in the cooling operation and the heating operation, but on the other hand, the electromagnetic valve 23 of the indoor unit 2 is closed in the positive cycle defrost operation.

<Cooling Operation>

In the air conditioner having the above configuration, during the cooling operation, when the four-way switching valve 12 is switched to a dotted line switching position and the compressor 11 is started, the high-temperature and high-pressure refrigerant discharged from the compressor 11 flows into the outdoor heat exchanger 14 through the four-way switching valve 12. Then, the refrigerant condensed by the outdoor heat exchanger 14 enters the first and second indoor heat exchangers 21 and 22 after being decompressed by the electric expansion valve 13. The refrigerant evaporated in the first and second indoor heat exchangers 21 and 22 returns to the intake side of the compressor 11 through the four-way switching valve 12 and the accumulator 15 (cooling cycle).

In this way, the refrigerant circulates in the order of the compressor 11, the outdoor heat exchanger 14, the electric expansion valve 13, the first and second indoor heat exchangers 21 and 22, and the accumulator 15, and the room is cooled by circulating the indoor air by the indoor fan 24 through the first and second indoor heat exchangers 21 and 22 that function as evaporators.

<Heating Operation>

Further, during the heating operation, when the four-way switching valve 12 is switched to a solid line switching position and the compressor 11 is started, the high-temperature and high-pressure refrigerant discharged from the compressor 11 flows into the first and second indoor heat exchangers 21 and 22 through the four-way switching valve 12. Then, the refrigerant condensed by the first and second indoor heat exchangers 21 and 22 enters the outdoor heat exchanger 14 after being decompressed by the electric expansion valve 13. The refrigerant evaporated in the outdoor heat exchanger 14 returns to the intake side of the compressor 11 through the four-way switching valve 12 and the accumulator 15 (heating cycle).

In this way, the refrigerant circulates in the refrigerant circuit including the compressor 11, the first and second indoor heat exchangers 21 and 22, the electric expansion valve 13, the outdoor heat exchanger 14, and the accumulator 15, and the indoor fan 24 circulates the indoor air through the first and second indoor heat exchangers 21 and 22 that function as condensers. This allows the room to be heated.

<Positive Cycle Defrost Operation>

When it is detected that the frost is formed on the outdoor heat exchanger 14 by such as a temperature sensor (not shown) that detects a temperature drop of the outdoor heat exchanger 14 during the heating operation, the heating operation is terminated and the positive cycle defrost operation of melting the frost adhered on the outdoor heat exchanger 14 is started. After the frost adhered to the outdoor heat exchanger 14 has melted, the positive cycle defrost operation is terminated and the heating operation is resumed. Whether or not the frost adhered to the outdoor heat exchanger 14 has melted is determined by the temperature of the outdoor heat exchanger 14 and/or the discharge refrigerant temperature of the compressor 11.

Note that the positive cycle defrost operation is an operation of removing the frost on the outdoor heat exchanger 14 by circulating the refrigerant in the order of the compressor 11, the first and second indoor heat exchangers 21 and 22, the electric expansion valve 13, and the outdoor heat exchanger 14, in a state of the heating cycle in which the four-way switching valve 12 is shown by the solid line in FIG. 1, similarly to the heating operation.

In this positive cycle defrost operation, by closing the electromagnetic valve 23 of the indoor unit 2, excess refrigerant among the refrigerant filled in the refrigerant circuit is stored in the second indoor heat exchanger 22, and the remaining refrigerant passes the first indoor heat exchanger 21 and circulates through the refrigerant circuit. The electromagnetic valve 23 of the indoor unit 2 is controlled by the control device (outdoor control unit 10 and indoor control unit 20) to adjust the amount of refrigerant stored in the second indoor heat exchanger 22 during the positive cycle defrost operation.

Figure 2:
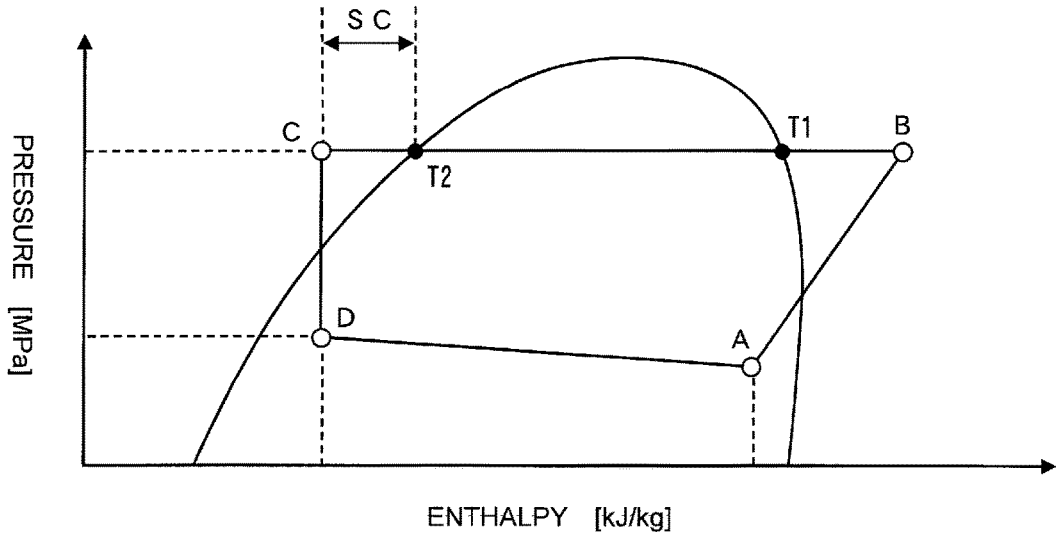
FIG. 2 is a Mollier chart during heating operation of the air conditioner.
Figure 3:
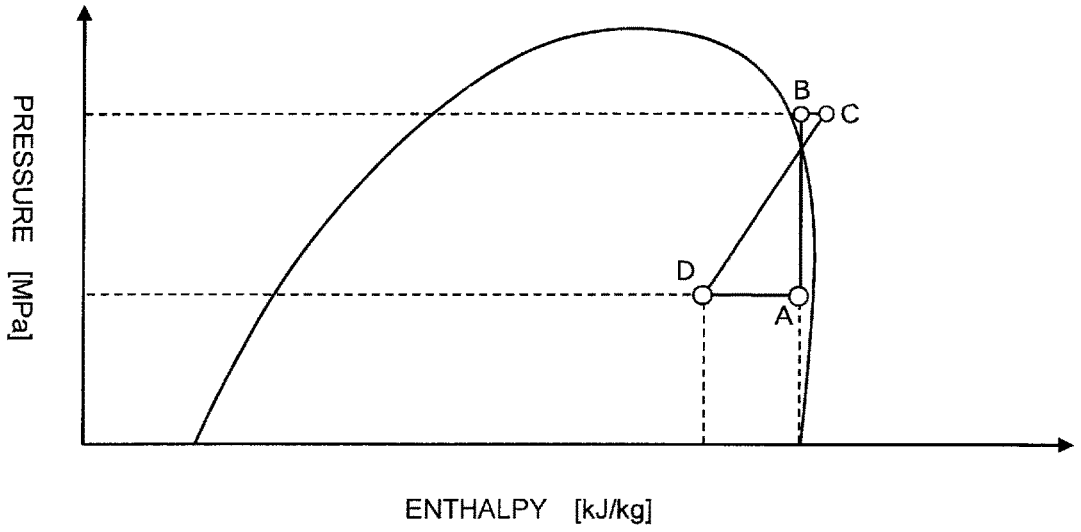
FIG. 3 is a Mollier chart during positive cycle defrost operation of the air conditioner.

FIG. 2 is a Mollier chart during the heating operation of the air conditioner, and FIG. 3 is a Mollier chart during the positive cycle defrost operation of the air conditioner. In FIGS. 2 and 3, the vertical axis represents pressure [MPa] and the horizontal axis represents enthalpy [kJ/kg].

The inside of the curves shown in FIGS. 2 and 3 is wet steam, the left side of the curve (saturated liquid line) is supercooled liquid, and the right side of the curve (saturated steam line) is superheated steam. Note that, in FIGS. 2 and 3, A to B is the compression process, B to C is the condensation process, C to D is the expansion process, and D to A is the evaporation process. Between B and C in the condensation process of FIG. 2, a point T1 on the saturated vapor line is the dew point, and a point T2 on the curve (saturated liquid line) is the boiling point. In the condensation process at C, the refrigerant has become the supercooled liquid (SC).

As can be seen from the Mollier chart during the heating operation and the positive cycle defrost operation, the amount of refrigerant required in the heating operation is, for example, 1300 g, but as shown in FIG. 2, the amount of refrigerant required in the positive cycle defrost operation is reduced by, for example, 200 g, which generates 1100 g of surplus refrigerant.

In the above air conditioner, in the positive cycle defrost operation, by closing the electromagnetic valve 23 of the indoor unit 2 and storing the excess refrigerant in the second indoor heat exchanger 22, the wet operation is not performed during the positive cycle defrost operation, therefore, the discharge temperature can be increased and the gas refrigerant passing through the first indoor heat exchanger 21 does not reach the two-phase region, and the inlet temperature of the outdoor heat exchanger 14 can be increased.

In this way, in the above air conditioner, in the positive cycle defrost operation, the liquid compression of the compressor 11 by the surplus refrigerant is prevented, and the defrosting performance can be prevented from being lowered due to the wet operation caused by the surplus refrigerant.

Therefore, in the air conditioner (heat pump device) having the above configuration, the reliability and the defrosting performance of the compressor 11 can be improved.

Further, by using the second indoor heat exchanger 22 (second use-side heat exchanger) connected in parallel to the first indoor heat exchanger 21 as the storage unit, the indoor heat exchanger (use-side heat exchanger) is divided into two parts and one of the divided parts is used as the storage unit without providing a separate storage unit, therefore, the configuration can be simplified and the cost can be reduced.

In the first embodiment, the electromagnetic valve 23 is used as the flow rate adjusting unit, but an electric expansion valve or the like whose opening degree can be adjusted may be used as the flow rate adjusting unit. In this case, the electric expansion valve may be controlled to close or throttle the opening degree during the positive cycle defrost operation.

Further, in the above first embodiment, the indoor heat exchanger (use-side heat exchanger) is divided into two parts and one of the divided parts is used as the storage unit, but the use-side heat exchanger may be divided into three or more parts and a part of the divided parts may be used as the storage unit.

Second Embodiment

Figure 4:
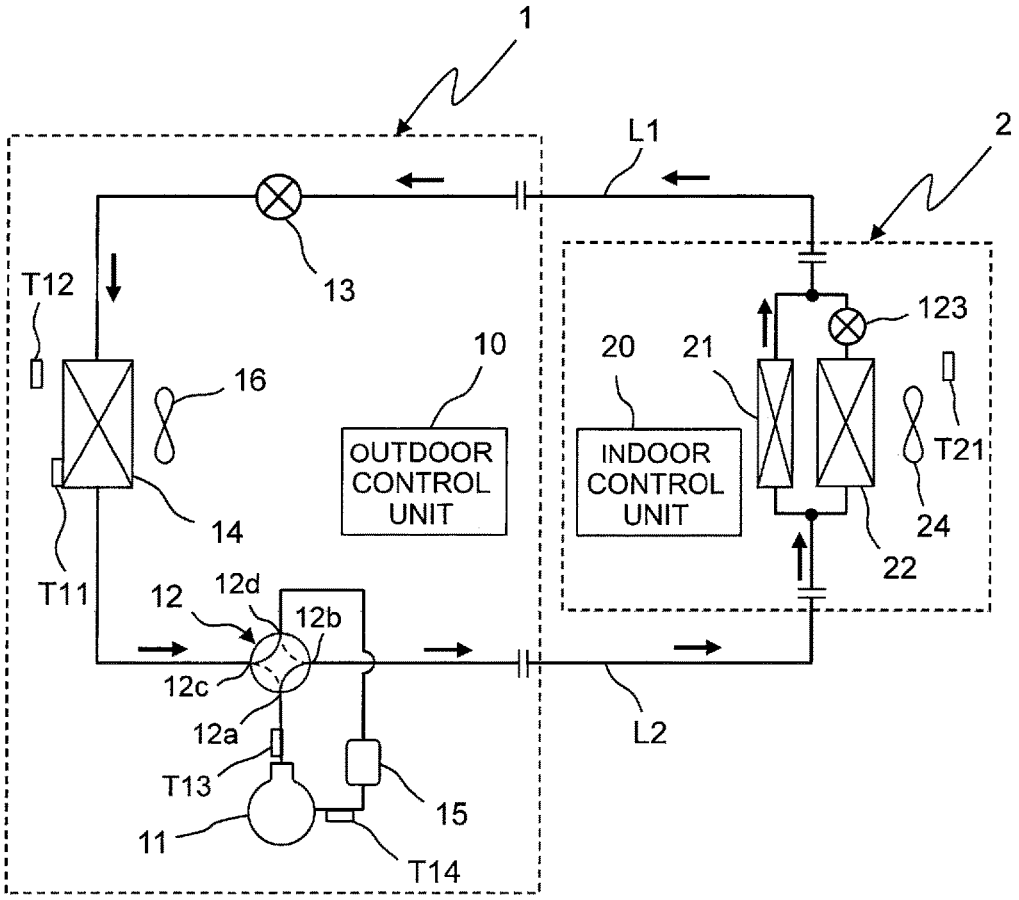
FIG. 4 is a circuit diagram of a refrigerant circuit of an air conditioner as an example of a heat pump device according to a second embodiment of the present disclosure.

FIG. 4 is a circuit diagram of a refrigerant circuit of an air conditioner as an example of a heat pump device according to a second embodiment of the present disclosure. The air conditioner of the second embodiment has the same configuration as the air conditioner of the first embodiment except for an electric expansion valve 123.

In the air conditioner of the second embodiment, the electric expansion valve 123 is provided at the electric-expansion-valve 13-side (connection-pipe L1-side) port of the second indoor heat exchanger 22. The electric expansion valve 123 is an example of the flow rate adjusting unit. The second indoor heat exchanger 22 is an example of the storage unit, and is located on the downstream side in the refrigerant flow of the compressor 11 in the positive cycle defrost operation and on the upstream side in the refrigerant flow of the electric expansion valve 13 in the positive cycle defrost operation. The electric expansion valve 123 is controlled by the control device (outdoor control unit 10, indoor control unit 20) to adjust the amount of refrigerant stored in the second indoor heat exchanger 22 during the positive cycle defrost operation.

In the above air conditioner, the control device (outdoor control unit 10 and indoor control unit 20) controls the electric expansion valve 123 so that, during the positive cycle defrost operation, as the temperature difference between the intake refrigerant temperature of the compressor 11 detected by the intake refrigerant temperature sensor T14 and the temperature of the outdoor heat exchanger 14 (heat source-side heat exchanger) detected by the outdoor heat exchanger temperature sensor T11 increases, the opening degree of the electric expansion valve 123 (flow rate adjusting unit) increases, and meanwhile, as the above temperature difference reduces, the opening degree of the electric expansion valve 123 reduces. As a result, the amount of heat required for defrosting the outdoor heat exchanger 14 can be secured, and the defrosting performance can be further improved.

Alternatively, the control device (outdoor control unit 10 and indoor control unit 20) may control the electric expansion valve 123 so that, during the positive cycle defrost operation, as the discharge refrigerant temperature of the compressor 11 detected by the discharge refrigerant temperature sensor T13 becomes higher, the opening degree of the electric expansion valve 123 increases, and meanwhile, as the above discharge refrigerant temperature becomes lower, the opening degree of the electric expansion valve 123 reduces. As a result, the amount of heat required for defrosting the outdoor heat exchanger 14 can be secured, and the defrosting performance can be further improved.

The air conditioner of the second embodiment has effects similar to those of the air conditioner of the first embodiment.

Further, in the second embodiment, the indoor heat exchanger (use-side heat exchanger) is divided into two parts and one of the divided parts is used as the storage unit, but the use-side heat exchanger may be divided into three or more parts and a part of the divided parts may be used as the storage unit.

Third Embodiment

Figure 5:
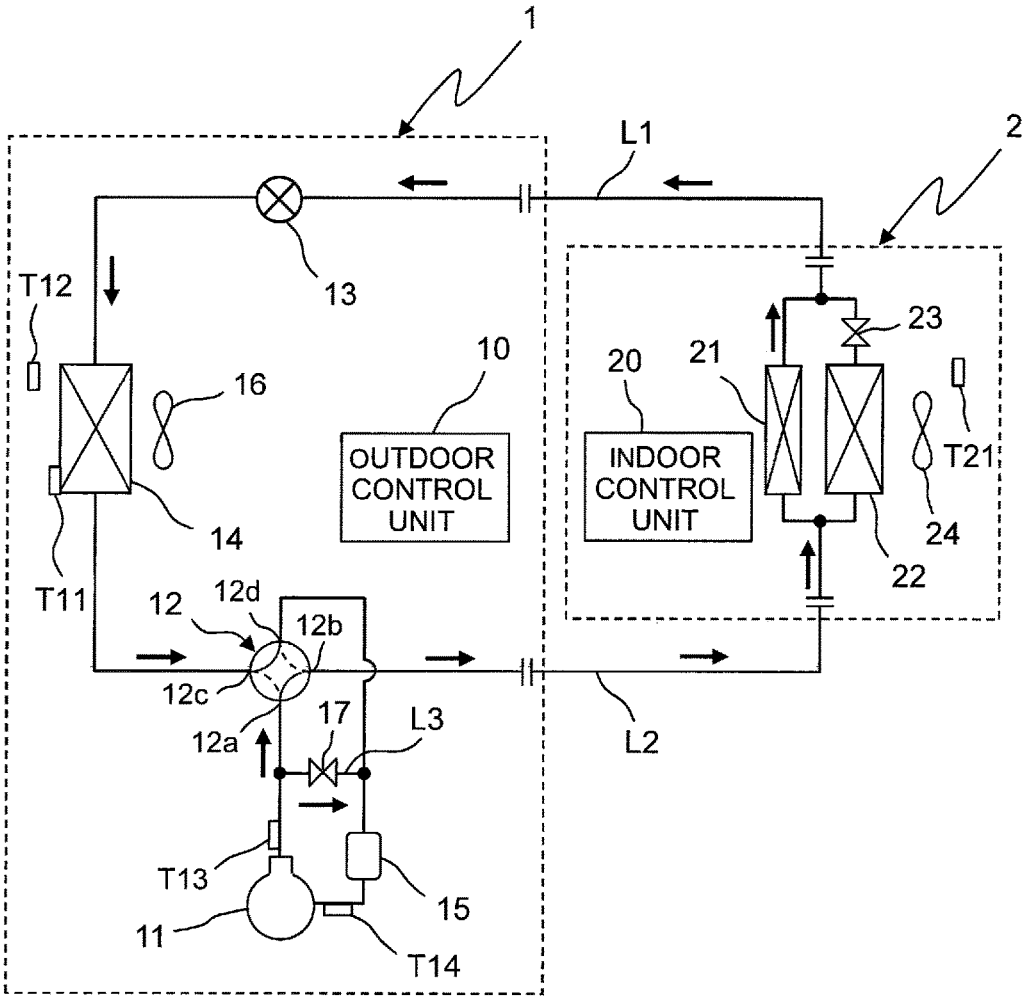
FIG. 5 is a circuit diagram of a refrigerant circuit of an air conditioner as an example of a heat pump device according to a third embodiment of the present disclosure.

FIG. 5 is a circuit diagram of a refrigerant circuit of an air conditioner as an example of a heat pump device according to a third embodiment of the present disclosure. The air conditioner of the third embodiment has the same configuration as the air conditioner of the first embodiment except for a bypass circuit L3 and an electromagnetic valve 17.

The air conditioner includes the bypass circuit L3 that connects the discharge port side and the intake port side of the compressor 11, and the electromagnetic valve 17 arranged in the bypass circuit L3. The electromagnetic valve 17 is an example of a bypass circuit flow rate adjusting unit. Further, the electromagnetic valve 17 is controlled by the outdoor control unit 10 and is closed except for the positive cycle defrost operation.

According to the air conditioner of the third embodiment, by the outdoor control unit 10 controlling the electromagnetic valve 17 arranged in the bypass circuit L3 connecting the discharge port side and the intake port side of the compressor 11, the electromagnetic valve 17 is opened during the positive cycle defrost operation. As a result, the liquid back to the compressor 11 and the decrease in high pressure can be suppressed.

The air conditioner of the third embodiment has effects similar to those of the air conditioner of the first embodiment.

In the third embodiment, the electromagnetic valve 23 is used as the flow rate adjusting unit, but as in the second embodiment, an electric expansion valve or the like whose opening degree can be adjusted may be used as the flow rate adjusting unit.

Further, in the third embodiment, the indoor heat exchanger (use-side heat exchanger) is divided into two parts and one of the divided parts is used as the storage unit, but the use-side heat exchanger may be divided into three or more parts and a part of the divided parts may be used as the storage unit.

Fourth Embodiment

Figure 6:
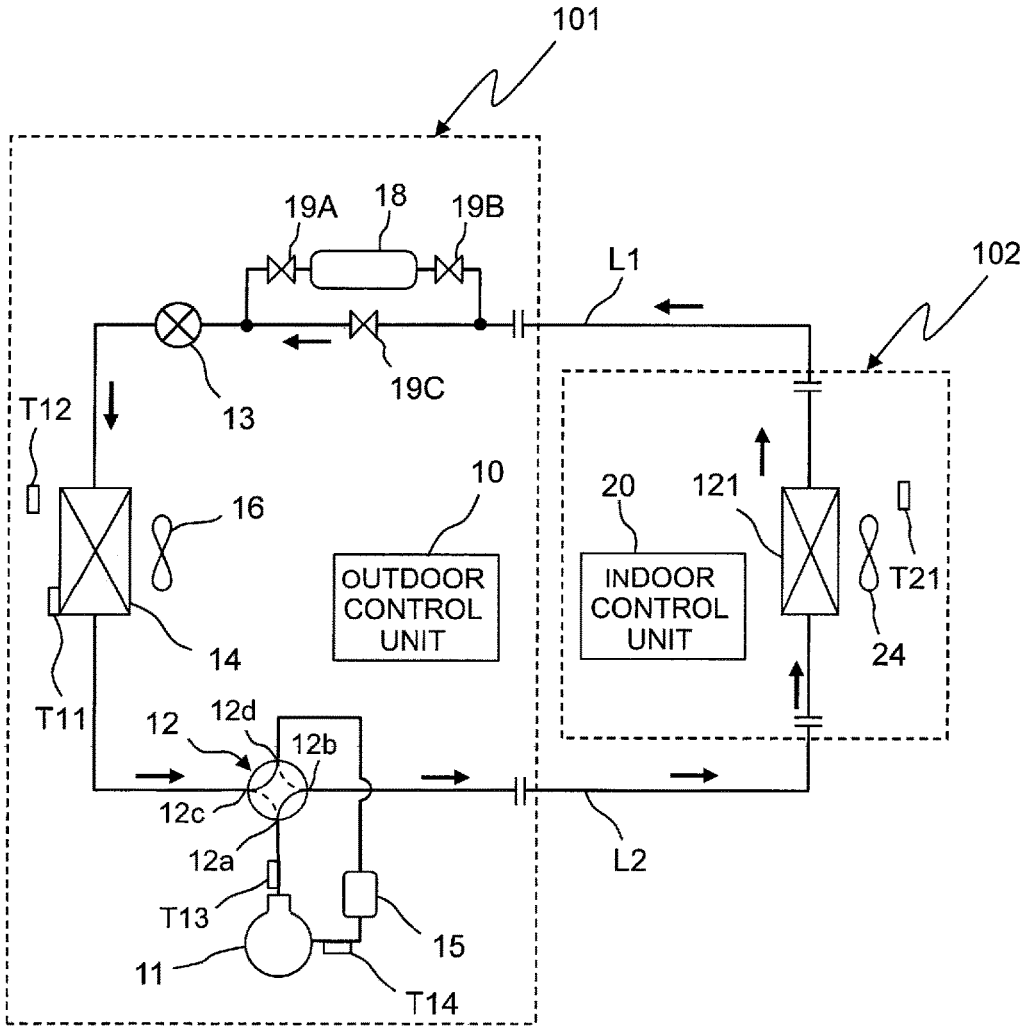
FIG. 6 is a circuit diagram of a refrigerant circuit of an air conditioner as an example of a heat pump device according to a fourth embodiment of the present disclosure.

FIG. 6 is a circuit diagram of a refrigerant circuit of an air conditioner as an example of a heat pump device according to a fourth embodiment of the present disclosure. The air conditioner of the fourth embodiment is different from the air conditioner of the first embodiment in that a refrigerant container 18 is used as the storage unit.

As shown in FIG. 6, the air conditioner of the fourth embodiment includes an outdoor unit 101 and an indoor unit 102 connected to the outdoor unit 101 via connection pipes L1 and L2.

The outdoor unit 101 includes an outdoor control unit 10, a compressor 11, a four-way switching valve 12, an electric expansion valve 13, an outdoor heat exchanger 14, an accumulator 15, and an outdoor fan 16. Further, the outdoor fan 16 supplies the outdoor air to the outdoor heat exchanger 14.

Further, the outdoor unit 101 includes an outdoor heat exchanger temperature sensor T11 that detects the temperature of the outdoor heat exchanger 14, an outdoor air temperature sensor T12 that detects the outdoor air temperature, a discharge refrigerant temperature sensor T13 that detects the discharge refrigerant temperature of the compressor 11, and an intake refrigerant temperature sensor T14 that detects the intake refrigerant temperature of the compressor 11.

Further, the indoor unit 102 includes an indoor control unit 20, an indoor heat exchanger 121, an indoor fan 24, and an indoor temperature sensor T21 that detects the indoor temperature. The indoor fan 24 circulates the indoor air through the indoor heat exchanger 121. The indoor heat exchanger 121 is an example of the use-side heat exchanger.

The discharge side of the compressor 11 is connected to a first port 12*a* of the four-way switching valve 12. A second port 12*b* of the four-way switching valve 12 is connected to one end of the indoor heat exchanger 121 via the connection pipe L2. The other end of the indoor heat exchanger 121 is connected to one end of the electric expansion valve 13 via the connection pipe L1. The other end of the electric expansion valve 13 is connected to one end of the outdoor heat exchanger 14, and the other end of the outdoor heat exchanger 14 is connected to a third port 12*c* of the four-way switching valve 12. Then, a fourth port 12*d* of the four-way switching valve 12 is connected to the intake side of the compressor 11 via the accumulator 15.

The compressor 11, the four-way switching valve 12, the indoor heat exchanger 121, the electric expansion valve 13, the outdoor heat exchanger 14, and the accumulator 15 are connected in a loop to constitute a refrigerant circuit.

Further, the air conditioner includes a refrigerant container 18 connected in parallel to a pipe between the indoor heat exchanger 121 (use-side heat exchanger) and the electric expansion valve 13, an electromagnetic valve 19A (first flow rate adjusting unit) that opens and closes an electric-expansion-valve 13-side port of the refrigerant container 18, an electromagnetic valve 19B (second flow rate adjusting unit) that opens and closes an indoor-heat-exchanger 121-side port of the refrigerant container 18, and an electromagnetic valve 19C (third flow rate adjusting unit) arranged in the pipe between the indoor heat exchanger 121 and the electric expansion valve 13, and connected in parallel with the refrigerant container 18. The electromagnetic valve 19A is an example of the flow rate adjusting unit arranged between the refrigerant container 18 (storage unit) and the electric expansion valve 13 (expansion mechanism). The refrigerant container 18 is an example of a storage unit, and is located on the downstream side in the refrigerant flow of the compressor 11 in the positive cycle defrost operation and on the upstream side in the refrigerant flow of the electric expansion valve 13 in the positive cycle defrost operation. Further, the electromagnetic valve 19A (first flow rate adjusting unit) is controlled by a control device (outdoor control unit 10 and indoor control unit 20) to adjust the amount of refrigerant stored in the refrigerant container 18 during the positive cycle defrost operation.

In the air conditioner having the above configuration, the electromagnetic valves 19A and 19B are closed and the electromagnetic valve 19C is opened during the heating operation, and there is hardly any refrigerant in the refrigerant container 18.

Next, immediately before the positive cycle defrost operation is started, the electromagnetic valves 19A and 19B are opened and the electromagnetic valve 19C is closed, so that the refrigerant flows through the refrigerant container 18.

Then, during the positive cycle defrost operation, the electromagnetic valves 19B and 19C are opened and the electromagnetic valve 19A is closed. As a result, the excess refrigerant is stored in the refrigerant container 18.

Then, when the positive cycle defrost operation is terminated, the electromagnetic valves 19A and 19C are opened and the electromagnetic valve 19B is closed.

In the above air conditioner, during the positive cycle defrost operation, in a state in which the electromagnetic valve 19A (first flow rate adjusting unit) is closed and the flow rate of the refrigerant flowing out from the electric-expansion-valve 13-side port of the refrigerant container 18 is set to zero, the electromagnetic valve 19B (second flow rate adjusting unit) is opened. This allows the indoor-heat-exchanger 121-side port of the refrigerant container 18 to be opened. As a result, the excess refrigerant can be stored in the refrigerant container 18. Further, in the cooling operation and the heating operation, by closing the electromagnetic valve 19B, the refrigerant can be prevented from being stored in the refrigerant container 18.

Further, during a period from a predetermined time before the positive cycle defrost operation is started to the time when the positive cycle defrost operation is started, the electromagnetic valve 19C (third flow rate adjusting unit) is closed in a state of the electromagnetic valves 19A and 19B being opened. This allows the refrigerant to flow only through the refrigerant container 18. When the positive cycle defrost operation is started, the electromagnetic valves 19B and 19C are opened in a state in which the electromagnetic valve 19A is closed and the flow rate of the refrigerant flowing out from the electric-expansion-valve 13-side port of the refrigerant container 18 is set to zero. As a result, the excess refrigerant can be reliably stored in the refrigerant container 18.

In the fourth embodiment, the air conditioner provided with the electromagnetic valves 19A, 19B, and 19C as the first to third flow rate adjusting units has been described, but also in an air conditioner provided with only the first flow rate adjusting unit, it is possible to store the excess refrigerant in the refrigerant container by closing the first flow rate adjusting unit during the positive cycle defrost operation.

Further, even in an air conditioner provided with only the first and second flow rate adjusting units, it is possible to store the excess refrigerant in the refrigerant container by closing the first flow rate adjusting unit and opening the second flow rate adjusting unit during the positive cycle defrost operation. In this case, in the operation other than the positive cycle defrost operation, the refrigerant can be prevented from being stored in the refrigerant container by closing the second flow rate adjusting unit.

The air conditioner of the fourth embodiment has effects similar to those of the air conditioner of the first embodiment.

In the fourth embodiment, the electromagnetic valve 19A is used as the flow rate adjusting unit, but an electric expansion valve or the like whose opening degree can be adjusted may be used as the flow rate adjusting unit.

Fifth Embodiment

Figure 7:
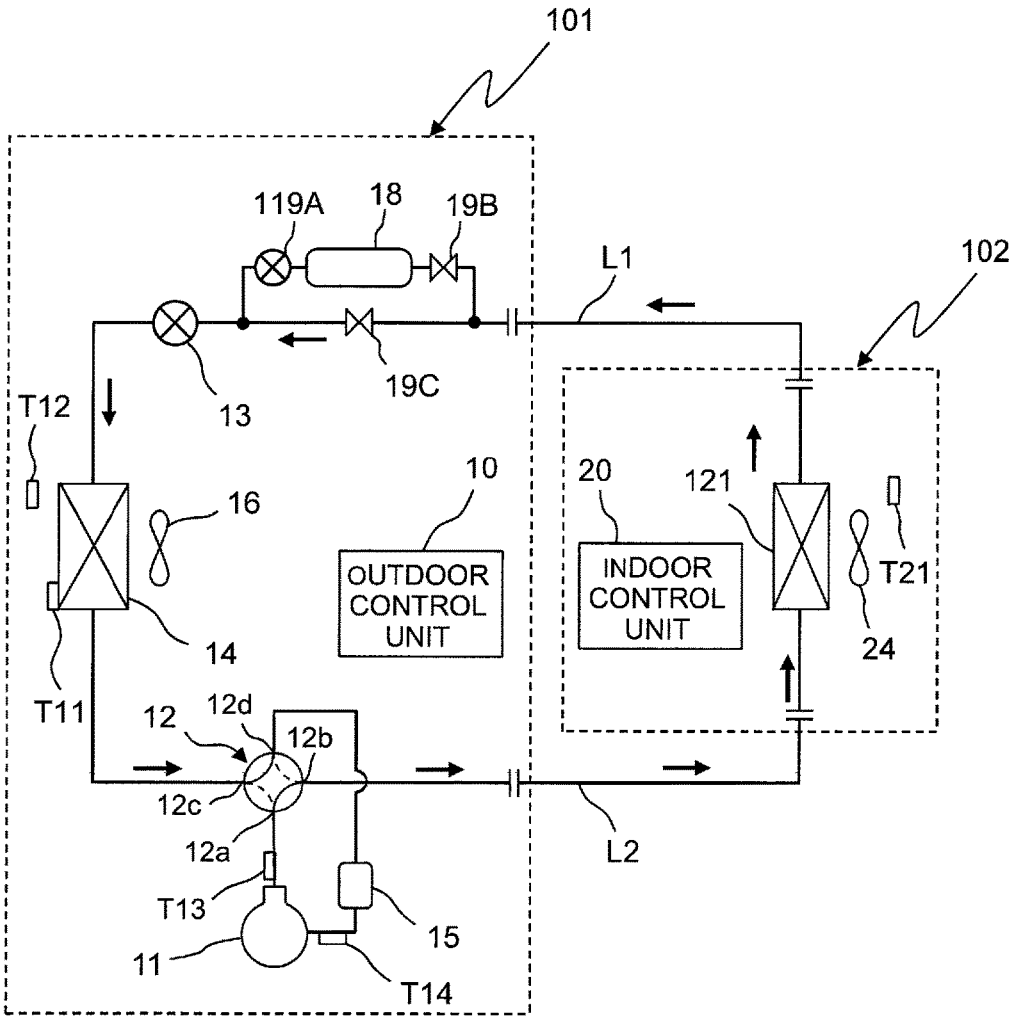
FIG. 7 is a circuit diagram of a refrigerant circuit of an air conditioner as an example of a heat pump device according to a fifth embodiment of the present disclosure.

FIG. 7 is a circuit diagram of a refrigerant circuit of an air conditioner as an example of a heat pump device according to a fifth embodiment of the present disclosure. The air conditioner of the fifth embodiment has the same configuration as the air conditioner of the fourth embodiment except for an electric expansion valve 119A.

The air conditioner of the fifth embodiment includes the electric expansion valve 119A that adjusts the flow rate of the refrigerant flowing into the electric-expansion-valve 13-side port of the refrigerant container 18 instead of the electromagnetic valve 19A of the fourth embodiment. The electric expansion valve 119A is an example of the flow rate adjusting unit.

In the above air conditioner, the control device (outdoor control unit 10 and indoor control unit 20) controls the electric expansion valve 123 so that, during the positive cycle defrost operation, as the temperature difference between the intake refrigerant temperature of the compressor 11 detected by the intake refrigerant temperature sensor T14 and the temperature of the outdoor heat exchanger 14 (heat source-side heat exchanger) detected by the outdoor heat exchanger temperature sensor T11 increases, the opening degree of the electric expansion valve 119A (flow rate adjusting unit) increases, and meanwhile, as the above temperature difference reduces, the opening degree of the electric expansion valve 119A reduces. As a result, the amount of heat required for defrosting the outdoor heat exchanger 14 can be secured, and the defrosting performance can be further improved.

Alternatively, the control device (outdoor control unit 10 and indoor control unit 20) may control the electric expansion valve 119A so that, during the positive cycle defrost operation, as the discharge refrigerant temperature of the compressor 11 detected by the discharge refrigerant temperature sensor T13 becomes higher, the opening degree of the electric expansion valve 119A increases, and meanwhile, as the above discharge refrigerant temperature becomes lower, the opening degree of the electric expansion valve 119A reduces. As a result, the amount of heat required for defrosting the outdoor heat exchanger 14 can be secured, and the defrosting performance can be further improved.

In the first to fifth embodiments, the air conditioner has been described as the heat pump device, but the heat pump device is not limited to this, and the present invention may be applied to other devices such as a hot water supply apparatus.

Although specific embodiments of the present disclosure have been described, the present disclosure is not limited to the first to fifth embodiments, and various modifications can be made within the scope of the present disclosure. For example, an appropriate combination of the configurations described in the first and fifth embodiments may be regarded as one embodiment of the present disclosure.

REFERENCE SIGNS LIST

1, 101 Outdoor unit
2, 102 Indoor unit
10 Outdoor control unit
11 Compressor
12 Four-way switching valve
13 Electric expansion valve
14 Outdoor heat exchanger (Heat source-side heat exchanger)
15 Accumulator
16 Outdoor fan
17 Electromagnetic valve
18 Refrigerant container
19A Electromagnetic valve (First flow rate adjusting unit)
19B Electromagnetic valve (Second flow rate adjusting unit)
19C Electromagnetic valve (Third flow rate adjusting unit)
20 Indoor control unit
21 First indoor heat exchanger (Use-side heat exchanger)
22 Second indoor heat exchanger (Second use-side heat exchanger, storage unit)
23 Electromagnetic valve (Flow rate adjusting unit)
24 Indoor fan
123, 119A Electric expansion valve (Flow rate adjusting unit)
121 Indoor heat exchanger (Use-side heat exchanger)
L1, L2 Connection pipe
L3 Bypass circuit
T11 Outdoor heat exchanger temperature sensor
T12 Outdoor air temperature sensor
T13 Discharge refrigerant temperature sensor
T14 Intake refrigerant temperature sensor
T21 Indoor temperature sensor

The invention claimed is:

1. A heat pump device comprising:

a refrigerant circuit in which a compressor, a first use-side heat exchanger, an expansion mechanism, and a heat source-side heat exchanger are connected in a loop;

a storage unit arranged between the compressor and the expansion mechanism;

a flow rate adjusting unit arranged between the storage unit and the expansion mechanism; and a control device that controls the compressor and the flow rate adjusting unit, wherein the control device is configured to adjust an amount of refrigerant stored in the storage unit during a positive cycle defrost operation, the storage unit is a second use-side heat exchanger, the flow rate adjusting unit is provided so as to be located on a downstream side of a port of the second use-side heat exchanger during the positive cycle defrost operation, the storage unit being the second use-side heat exchanger are connected in parallel to the first use-side heat exchanger, and the flow rate adjusting unit includes a first end and a second end, the first end being connected to a flow path guiding refrigerant from the first use-side heat exchanger to the expansion mechanism during the positive cycle defrost operation, the second end being connected to the second use-side heat exchanger.

2. The heat pump device according to claim 1, wherein the control device is configured to control the flow rate adjusting unit so as to throttle a flow rate of refrigerant flowing out from an expansion-mechanism-side port of the second use-side heat exchanger during the positive cycle defrost operation to store the refrigerant in the second use-side heat exchanger.

3. The heat pump device according to claim 1, further comprising:

a bypass circuit that connects a discharge port side and an intake port side of the compressor; and a bypass circuit flow rate adjusting unit arranged in the bypass circuit and controlled by the control device.

4. The heat pump device according to claim 1, wherein the control device is configured to control the flow rate adjusting unit so that, during the positive cycle defrost operation, as a temperature difference between an intake refrigerant temperature of the compressor and a temperature of the heat source-side heat exchanger increases, an opening degree of the flow rate adjusting unit increases, and meanwhile, as the temperature difference reduces, the opening degree of the flow rate adjusting unit reduces.

5. The heat pump device according to claim 1, wherein the control device is configured to control the flow rate adjusting unit so that, during the positive cycle defrost operation, as a discharge refrigerant temperature of the compressor increases, an opening degree of the flow rate adjusting unit increases, and meanwhile, as the discharge refrigerant temperature of the compressor reduces, the opening degree of the flow rate adjusting unit reduces.

6. A heat pump device comprising:

a refrigerant circuit in which a compressor, a use-side heat exchanger, an expansion mechanism, and a heat source-side heat exchanger are connected in a loop;

a storage unit being a refrigerant container connected in parallel to a pipe between the use-side heat exchanger and the expansion mechanism;

a first flow rate adjusting unit arranged between the refrigerant container and the expansion mechanism on a downstream side of the refrigerant container during a positive cycle defrost operation;

a third flow rate adjusting unit arranged between the use-side heat exchanger and the expansion mechanism, the third flow rate adjusting unit being connected in parallel to the refrigerant container and the first flow rate adjusting unit; and a control device that controls the compressor and the first flow rate adjusting unit during the positive cycle defrost operation, wherein the control device is configured to adjust an amount of refrigerant stored in the refrigerant container, the first flow rate adjusting unit throttles a flow rate of refrigerant flowing out from an expansion-mechanism-side port of the refrigerant container, and the first flow rate adjusting unit includes a first end and a second end, the first end being connected to a flow path guiding refrigerant from the third flow rate adjusting unit to the expansion mechanism during the positive cycle defrost operation, the second end being connected to the refrigerant container, wherein the heat pump device further comprises a second flow rate adjusting unit that opens and closes a use-side-heat-exchanger-side port of the refrigerant container, wherein during the positive cycle defrost operation, the control device is configured to open the second flow rate adjusting unit in a state in which the flow rate of the refrigerant flowing out from the expansion-mechanism-side port of the refrigerant container is throttled by the first flow rate adjusting unit, wherein the control device is configured to:

close the third flow rate adjusting unit in a state of the first flow rate adjusting unit and the second flow rate adjusting unit being opened, during a period from a predetermined time before the positive cycle defrost operation is started to a time when the positive cycle defrost operation is started, and during the positive cycle defrost operation, open the second flow rate adjusting unit and the third flow rate adjusting unit in a state in which the flow rate of the refrigerant flowing out from the expansion-mechanism-side port of the refrigerant container is throttled by the first flow rate adjusting unit.

7. The heat pump device according to claim 6, further comprising:

a bypass circuit that connects a discharge port side and an intake port side of the compressor; and a bypass circuit flow rate adjusting unit arranged in the bypass circuit and controlled by the control device.

8. The heat pump device according to claim 6, wherein the control device is configured to control the first flow rate adjusting unit so that, during the positive cycle defrost operation, as a temperature difference between an intake refrigerant temperature of the compressor and a temperature of the heat source-side heat exchanger increases, an opening degree of the first flow rate adjusting unit increases, and meanwhile, as the temperature difference reduces, the opening degree of the first flow rate adjusting unit reduces.

9. The heat pump device according to claim 6, wherein the control device is configured to control the first flow rate adjusting unit so that, during the positive cycle defrost operation, as a discharge refrigerant temperature of the compressor increases, an opening degree of the first flow rate adjusting unit increases, and meanwhile, as the discharge refrigerant temperature of the compressor reduces, the opening degree of the first flow rate adjusting unit reduces.

10. A heat pump device comprising:

a refrigerant circuit in which a compressor, a use-side heat exchanger, an expansion mechanism, and a heat source-side heat exchanger are connected in a loop;

a storage unit being a refrigerant container connected in parallel to a pipe between the use-side heat exchanger and the expansion mechanism;

a first flow rate adjusting unit arranged between the refrigerant container and the expansion mechanism;

a second flow rate adjusting unit that opens and closes a use-side-heat-exchanger-side port of the refrigerant container, a third flow rate adjusting unit arranged between the use-side heat exchanger and the expansion mechanism, the third flow rate adjusting unit being connected in parallel to the refrigerant container; and a control device that controls the compressor and the first flow rate adjusting unit, wherein the control device is configured to adjust an amount of refrigerant stored in the refrigerant container during a positive cycle defrost operation, the first flow rate adjusting unit throttles a flow rate of refrigerant flowing out from an expansion-mechanism-side port of the refrigerant container, the first flow rate adjusting unit includes a first end and a second end, the first end being connected to a flow path guiding refrigerant from the third flow rate adjusting unit to the expansion mechanism during the positive cycle defrost operation, the second end being connected to the refrigerant container, during the positive cycle defrost operation, the control device is configured to open the second flow rate adjusting unit in a state in which the flow rate of the refrigerant flowing out from the expansion-mechanism-side port of the refrigerant container is throttled by the first flow rate adjusting unit, and the control device is configured to:

close the third flow rate adjusting unit in a state of the first flow rate adjusting unit and the second flow rate adjusting unit being opened, during a period from a predetermined time before the positive cycle defrost operation is started to a time when the positive cycle defrost operation is started, and during the positive cycle defrost operation, open the second flow rate adjusting unit and the third flow rate adjusting unit in a state in which the flow rate of the refrigerant flowing out from the expansion-mechanism-side port of the refrigerant container is throttled by the first flow rate adjusting unit.

11. The heat pump device according to claim 10, further comprising:

a bypass circuit that connects a discharge port side and an intake port side of the compressor; and a bypass circuit flow rate adjusting unit arranged in the bypass circuit and controlled by the control device.

12. The heat pump device according to claim 10, wherein the control device is configured to control the first flow rate adjusting unit so that, during the positive cycle defrost operation, as a temperature difference between an intake refrigerant temperature of the compressor and a temperature of the heat source-side heat exchanger increases, an opening degree of the first flow rate adjusting unit increases, and meanwhile, as the temperature difference reduces, the opening degree of the first flow rate adjusting unit reduces.

13. The heat pump device according to claim 10, wherein the control device is configured to control the first flow rate adjusting unit so that, during the positive cycle defrost operation, as a discharge refrigerant temperature of the compressor increases, an opening degree of the first flow rate adjusting unit increases, and meanwhile, as the discharge refrigerant temperature of the compressor reduces, the opening degree of the first flow rate adjusting unit reduces.

* * * * *